United States Patent [19]

Mabuchi et al.

[11] 4,050,487

[45] Sept. 27, 1977

[54] ELECTRIC SHARPENER

[75] Inventors: Kenichi Mabuchi; Yoshihisa Tsuchimochi, both of Tokyo, Japan

[73] Assignee: Mabuchi Motor Co., Ltd., Tokyo, Japan

[21] Appl. No.: 642,164

[22] Filed: Dec. 18, 1975

[30] Foreign Application Priority Data

Dec. 26, 1974 Japan ..... 50-3610[U]
Feb. 27, 1975 Japan ..... 50-27108[U]

[51] Int. Cl.[2] ..... B43L 23/02

[52] U.S. Cl. ..... 144/28.5; 51/73 R; 81/57.31; 144/28.1; 144/28.4

[58] Field of Search ..... 144/28.3, 28.4, 28.5, 144/28.6, 28.7, 28.1; 51/73; 81/57.31; 310/50, 69

[56] References Cited

U.S. PATENT DOCUMENTS 2,561,438 7/1951 Duchesneau ..... 144/28.5
3,134,364 5/1964 Chelazzi ..... 144/28.4 X
3,935,909 2/1976 Mabuchi et al. ..... 310/50 X

FOREIGN PATENT DOCUMENTS 4,642,559 7/1968 Japan ..... 81/57.31

*Primary Examiner*—Othell M. Simpson
*Assistant Examiner*—W. D. Bray

[57] ABSTRACT

An electric sharpener is disclosed, wherein its sharpener section is driven by a motor powered from a self-contained battery in an arrangement that said motor and a reduction means for transmitting the revolving force of said motor to said sharpener section are housed in an inner case movable relative to an outer case in the lengthwise direction and the electrical connection between said self-contained battery and said motor is controlled by moving said inner case in said lengthwise direction with a pencil inserted into said sharpener section.

7 Claims, 9 Drawing Figures

ELECTRIC SHARPENER

BACKGROUND OF THE INVENTION

1. Field of the Invention

This invention relates to an electric sharpener and more particularly to an electric sharpener in which the switching control of electrical connection between the self-contained battery and the motor powered by said battery is simplified to prevent trouble such as poor connection and also to reduce the sharpener size.

2. Description of the Prior Art

The recently developed nickel-cadmium batteries are now increasingly in use as the power source for a variety of electric devices not only because they are small and lightweight but also they can be charged quickly in a little over 10 minutes and deliver high discharge current of several amperes.

FIG. 1 shows a discharge characteristic curve of 2 U3-type manganese dry cells in series connection as a power source connected to a load of about 1.3 A and another discharge characteristic curve of 2 U3-type nickel-cadmium cells in series connection as a similar power source to the above connected to 1.3 A load.

In FIG. 1, the $x$ axis represents the time (minute) and the $y$ axis represents the voltage (V), and the full-line curve is the discharge characteristic of the above manganese dry cells and the broken-line curve is that of the above nickel-cadmium cells.

As it is apparent in FIG. 1, the terminal voltage in the case of the above manganese dry cells drops sharply in the early stage of discharge and goes down below 2.0 V in about 1 minute, but the terminal voltage of the above nickel-cadmium cells is maintained at 2.0 V or above for about 16 minutes after starting the discharge.

An electric sharpener has been known, which comprises a sharpener section, self-contained battery, and a motor powered by said battery and sharpens a pencil by rotating the sharpener section driven from the motor, and this electric sharpener has a reduction means between the motor and the sharpener section to obtain an output of force required for the sharpener section to sharpen the pencil.

In using the above electric sharpener, if U3-type manganese dry cells are employed as the self-contained battery and if the terminal voltage of the battery for effectively driving the sharpener is required to be, for example, not lower than 2.0 V, it is apparent from FIG. 1 that the continuous operating time of the sharpener is only one minute and this will require frequent and uneconomical renewals of the battery. For this reason the above conventional sharpener has been compelled to employ large U1-type manganese dry cells making it difficult to reduce the size of its power source section. Also, the reduction means is so constructed that the first pinion gear fixed on the motor shaft meshes with the second gear to reduce the number of motor revolution by their gear ratio and similar gear sets are provided in numbers required for obtaining a desired number of motor revolution.

The above large size reduction means and the necessity of using U1-type cells account for the fact that it has been difficult to provide a conventional sharpener in an economical and convenient portable type.

Also, in the conventional electric sharpener, a switching means is usually provided on the back of the sharpener section for switching control of the motor and the battery and, when a pencil is inserted into the sharpener section, the switching means is turned on to drive the motor. in this case, electrical, connection between the switching means, the motor, and the battery generally is made with lead wire, but this type of connection tends to be troubled by the breakage of lead wire or other causes, so there are cases where it is difficult to ensure good electrical connection in this way.

SUMMARY OF THE INVENTION

The object of this invention is to provide an electric sharpener which successfully resolves the above described problems and, in particular, to provide an economical and convenient portable type electric sharpener capable of long continuous operation by using nickel-cadmium cells as its self-contained battery and also providing a motor revolution reducing means employing planetary gears.

Another object of this invention is to provide an electric sharpener which is simple to switch on or off by means of an inner case housing a reduction means and a motor and movable relative to an outer case in the lengthwise direction of the switching control of the motor and the battery by the lengthwise sliding of said inner case.

A further object of this invention is to provide an electric sharpener, wherein pencil shavings in the sharpener section case is prevented from entering the above mentioned motor housing inner case by forming said inner case to have a protruded member over the motor output shaft which drives the sharpener section.

A further object of this invention is to provide an electric sharpener, wherein the pushing force applied to the sharpener section is transmitted to said above protruded member so that the pushing force applied to the motor output shaft is substantially reduced to protect reduction gears from exertion.

DETAILED DESCRIPTION OF PREFERRED EMBODIMENTS

Figure 1:
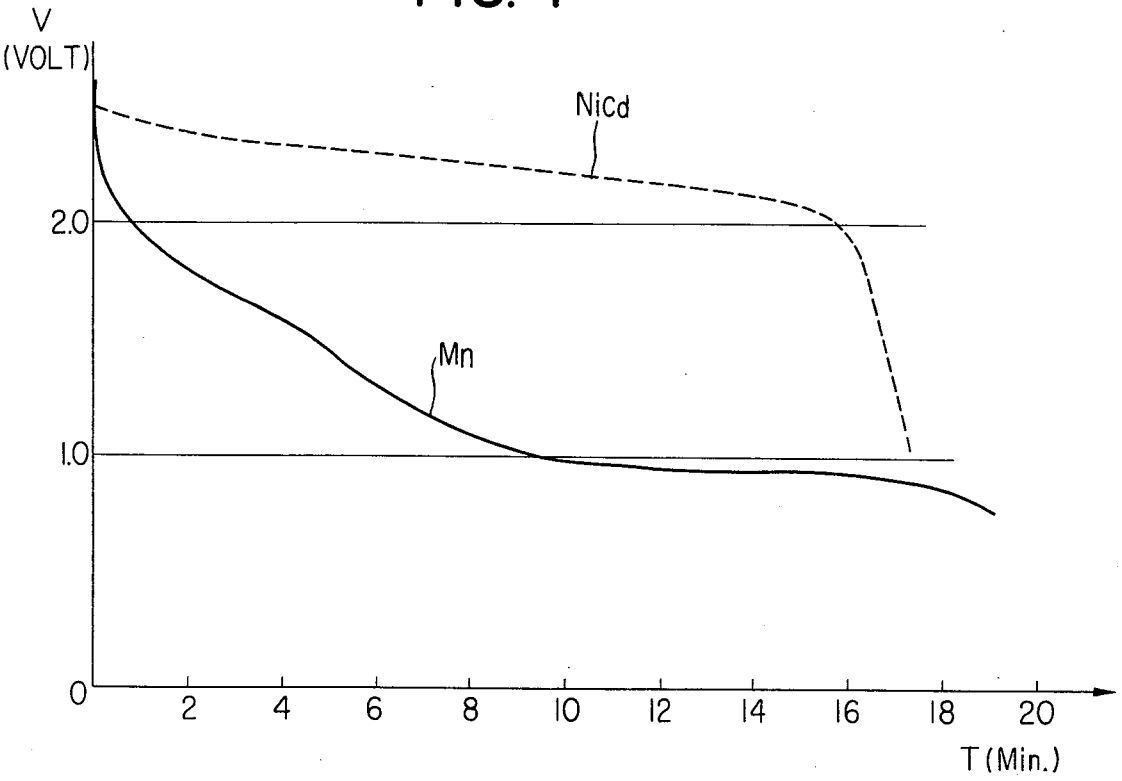
FIG. 1 shows discharge characteristics of manganese type dry cells and nickel-cadmium cells.
Figure 2:
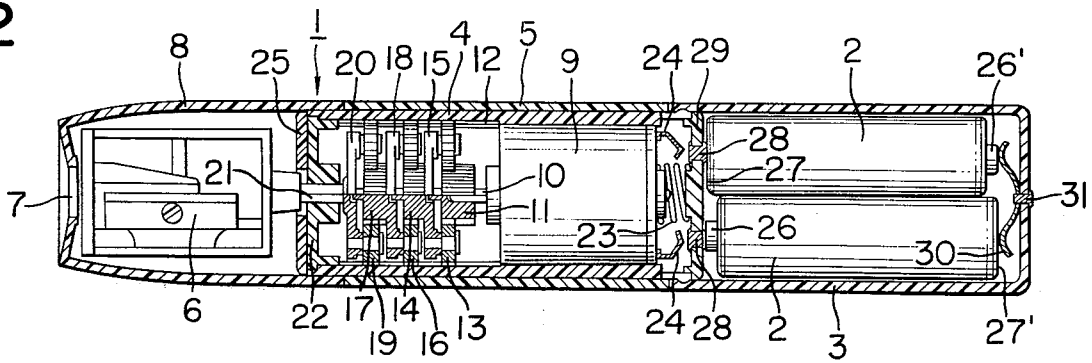
FIG. 2 is a general longitudinal section of an electric sharpener as an embodiment of this invention.

In FIG. 2, this electric sharpener 1 comprises: a battery means 2; a battery case 3 an inner case (4); an outer case 5 which permits the inner case 4 to slide in the lengthwise direction; and a sharpener section housing case 8, which houses a sharpener section 6 and which has on its end face a pencil insertion hole 7. A motor 9 is supported on the inside wall surface of the inner case 4, and on its revolving shaft 10 is mounted a first pinion gear 11. Between the first pinion gear 11 and a ring gear 12 which is supported by the inside wall of the inner case 4, a first planetary gear 13 is located. The first planetary gear 13 and a second pinion gear 14 are connected through a first gear arm 15, and between the second pinion gear 14 and the above ring gear 12, a second planetary gear 16 is located. Then, in a manner similar to the above, the second planetary gear 16 and a third pinion gear 17 are connected through a second gear arm 18, and between the third pinion gear 17 and the above ring gear 12, a third planetary gear 19 is located to transmit the revolution of the third planetary gear 19 through a third gear arm 20 to an output shaft 21 which engages with the sharpener section 6.

As explained above, a three-stage reduction means, consisting of the first, second, and third pinion gears 11, 14, 17 and the first, second, and third planetary gears 13, 16, 19 and the first, second, and third gear arms 15, 18, 20 and the above ring gear 12, is provided in this embodiment to transmit the revolution of the motor 9 to the sharpener section 4.

Figure 3:
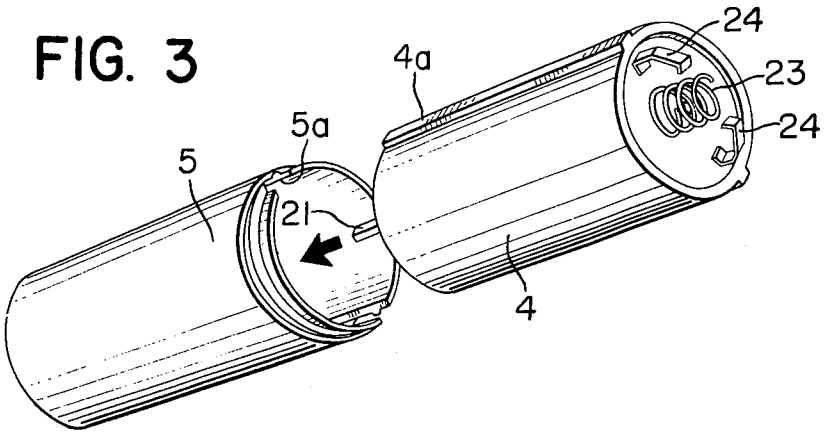
FIG. 3 is a perspective drawing showing the relationship of the inner case and the outer case.

The end face of the inner case 6 facing the sharpener section 4 has an integral bearing 22 which supports the above output shaft 21, and to the other end face of the sharpener section facing the battery case 3 are attached a spring 23 and also electrically conductive leaf springs 24, 24 for connection to the terminals of the motor 9, as illustrated in FIG. 3. The inner case 4 and the sharpener section housing case 8 are separated from each other by a partition wall 25 with an opening in the center and held by circumferential wall surface of the sharpener section housing case 8, while the inner case 4 and the battery case 3 are separated from each other by a partition wall 29 held by the inside circumferent surface of the battery case 3 and having connectors 28, 28 which provide electrical contact between the above mentioned conductive leaf springs 24, 24 and a positive (+) terminal 26 and a (−) terminal of the battery 2. In the center of the other end face of the battery case 3, a connector holder 31 is provided to support a connecting strip 30 which connects another (+) terminal 26' and another (−) terminal 27' of the battery 2.

Figure 4:
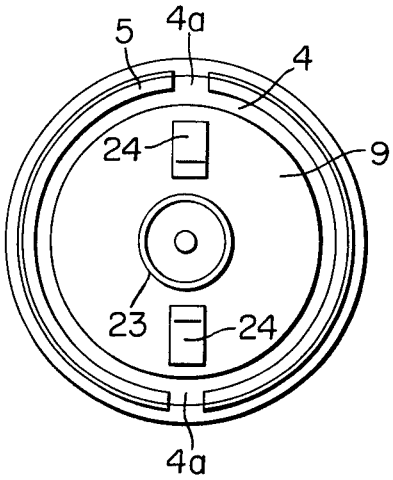
FIG. 4 is their front view.

FIG. 3 shows the relation between the inner case 4 and the outer case 5. As it is apparent in FIG. 3, ridge 4a is formed on the outer surface of the inner case running in the lengthwise direction, while a groove 5a is formed on the inside surface of the outer case 5 to accommodate the ridge 4a and to permit the ridge to slide in the groove 5a, so that the inner case 4 can make a sliding movement relative to the outer case 5 in the lengthwise direction. If course, no rotational displacement between the outer case 5 and the inner case 4 is not permitted. FIG. 4 is the front view of the inner case 4 and the outer case 5, with the former inserted into the latter as shown by an arrow in FIG. 3.

Next, the switching control of the motor 9 and the battery 2, 2 will be explained by referring to FIG. 5 and FIG. 6.

Figure 5:
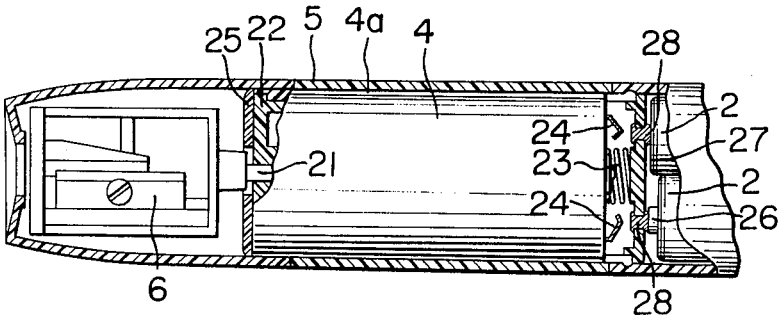
FIG. 5 and FIG. 6 are longitudinal sections of portions of the electric sharpener illustrating the switching control of the motor and the battery.

As shown in FIG. 5, when a pencil is not inserted into the sharpener section 6, the inner case 4 is pushed by the spring 23 into contact with the partition wall 25 of the sharpener section 6 and in this case, as illustrated in FIG. 5, leaf springs 24, 24 attached to the terminals of the motor 9 are out of electrical contact with connectors 28, 28 and the motor 9 is not powered.

Figure 6:
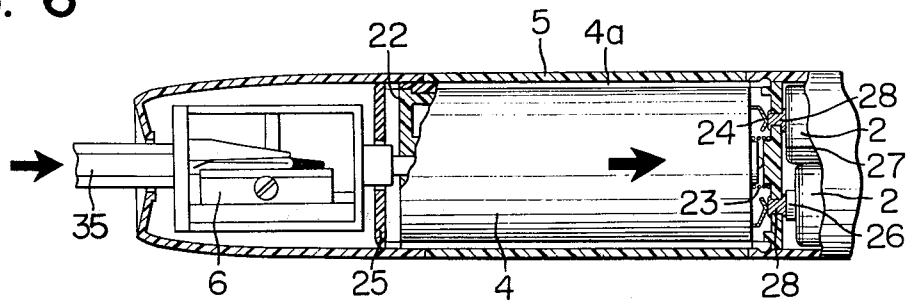

FIG. 6 illustrates the condition when a pencil is inserted into the sharpener section 6. Pushing the pencil 32, inserted into the sharpener section 6, in the direction indicated by the arrow in the drawing moves both the sharpener section 6 and the inner case 4 in the direction of the arrow head, because the inner case 4 can slide inside the outer case 5 in the lengthwise direction as has been explained. This movement of the inner case 4 compresses the spring 23 as illustrated in FIG. 6, and brings the leaf springs 24, 24 into contact with connectors 28, 28 to provide electrical connection between the motor 9 and the battery 2, 2, and the motor 9 so powered starts revolving the sharpener section 6. Needless to say, the motor 9 is driven as above only while the pencil 32 is being pushed in the direction of the arrow head in the drawing.

When the pencil 32 is freed from the above pushing force, the spring 23 will move the inner case 4 in the direction opposite to the direction of the arrow head in the drawing, restoring the condition shown in FIG. 5 and the motor 9 ceases running.

In this way, the switching control of the motor (9) and the battery 2, 2 is made very easily by the user pushing or releasing the pencil.

As described above, through the use of small and lightweight nickel-cadmium cells capable of quick charging and high current discharging as the self-contained power source and provision of reduction means having planetary gears and also by housing the motor and the reductions means in the inner case which can move against the outer case of the sharpener in the lengthwise direction, it is now possible to make the sharpener economical and smaller sized and also to simplify the switching control of the motor and the self-contained battery and prevent troubles from poor or defective electrical connection.

Figure 7:
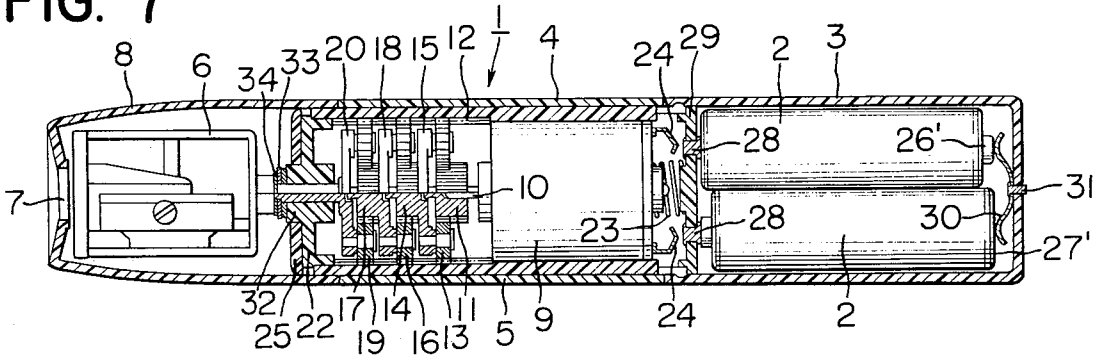
FIG. 7 is a general longitudinal section of another electric sharpener embodying this invention.

FIG. 7 is a general longitudinal section of another electric sharpener embodying this invention, and symbols 1 through 31 in the drawing correspond to those in FIG. 2.

In FIG. 7, 32 is a protruded member provided to the end face of the inner case 4 facing the sharpener section 6. This protruded member 32 engages with the center opening of the partition wall 25 with its outer surface slidable against the opening and its inner circumference supports the motor output shaft 21. 33 is a washer which, together with a retaining ring 34, constitutes a means which is called in this invention a pushing force dispersion means. This washer 33 and the retaining ring 34 are located between the sharpener section 6 and the protruding member 32 supporting the motor output shaft 21 and serve to disperse the force from the sharpener section pushing the motor output shaft 21 and transmit the dispersed force to the inner case 4. The retaining ring 34 engages with the motor output shaft (21), as shown in the drawing.

In the case of this embodiment, the relation between the inner case 4 and the outer case 5 is the same as that shown in FIG. 3 and FIG. 4, and the inner case 4 can move against the outer case 5 in the lengthwise direction.

Figure 8:
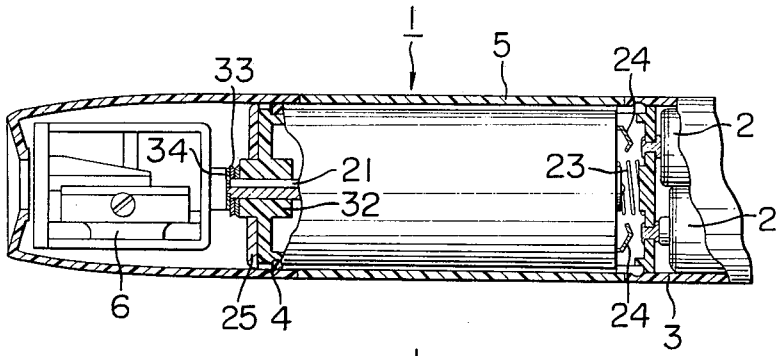
FIG. 8 and FIG. 9 are longitudinal sections showing main portions of the electric sharpener.
Figure 9:
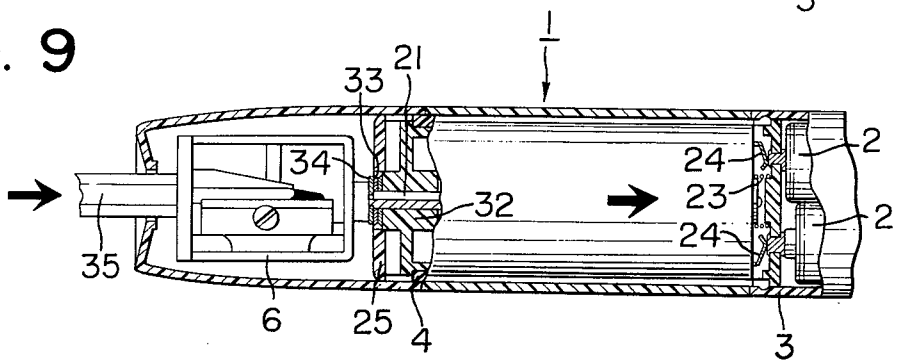

FIG. 8 and FIG. 9 illustrate the condition of the opening of the partition wall 25 and its neighborhood when pushing force is applied to the sharpener section 6 and how the battery 2, 2 and the motor 9 will be electrically positioned at this time.

FIG. 8 illustrates the condition where pushing force is not applied to the sharpener section 6, i.e., where a pencil is not inserted into the sharpener section 6, and this is the same condition as that shown in FIG. 7. As it is apparent in FIG. 8, the center opening of the partition wall 25 engages with the protruded member 32 of the inner case 4, and the motor 9 and the battery 2, 2 are kept by the elastic force of the spring 23 from electrically contacting with each other.

FIG. 9 illustrates the condition where a pencil (35) is inserted into the sharpener section 6 and applied with a pushing force in the direction of the arrow head in the drawing. This pushing force applied to the pencil 35 in the direction of the arrow head moves both the sharpener section 6 and the inner case 4 against the outer case 5 in the lengthwise direction (i.e., in the direction of the arrow head in the drawing), bringing the motor terminals 24, 24 into electrical contact with the positive and negative terminals of the battery 2 to power the motor 9 which then rotates the sharpener section 6 to shave and sharpen the pencil 35. This powering of the motor 9 is maintained only while the pencil 35 is being pushed in direction of the arrow head in the drawing.

The protruded member 32 of the inner case 4, which slides against the opening of the partition wall 25 with the above movement of the inner case 4, is so disposed that it is still partly in engagement with the opening of the partition wall 25 when the above movement reaches the rightward limit, as shown in FIG. 9.

Also, as the pushing force applied to the pencil 35 in the direction of the arrow head, i.e., the pushing force from the sharpener section 6 to the motor output shaft 21, is applied to the above protruded member 32 via the retaining ring 34 and the washer 33, the reduction means and the motor shaft 10 are protected from application of any excessive pushing force. In other words, the retaining ring 34 and the washer 33 permits the output shaft 21 to make no movement relation to the protruded member 32 in the axial direction even when a pushing force is applied to the output shaft 21, with the result that no change takes place in the positional relation between the output shaft 21 and the reduction means in the case of FIG. 8 and necessary gaps between gears are satisfactorily maintained to ensure the smooth rotation of the reduction means ans no unnecessary load will be created on the rotation of the motor 9.

As described above, this embodiment provides to the end face of the inner case 4 facing the sharpener section 6 the protruding member 32 which is slidably engaged with the opening of the partition wall 25 and also provides the washer 33 and the retaining ring 34 between the above protruded member 32 and the sharpener section 6. This arrangement prevents intrusion of pencil shavings from the opening of the partition wall 25 into the inner case 4 and also disperse the pushing force applied to the motor output shaft (21) to protect the motor output shaft 21 from application of excessive pushing force and minimize the possibility of troubles, thereby ensuring the stabilized rotation of the sharpener section 6.

What is claimed is:

1. An electric sharpener, comprising: a battery section a sharpener section; a battery powered motor; a reduction means having planetary gears for transmitting the output of said motor to said sharpener section; and a switch section located between said motor and the battery section; whereby said sharpener section, said motor, and said reduction means define a slidable body which can move in the axial direction so that said switch is controlled by said movement in the axial direction.

2. An electric sharpener in claim 1, wherein said motor and said reduction means are housed in an inner case constructed to be movable relative to an outer case surrounding said inner case in the axial direction.

3. An electric sharpener in claim 2, wherein a ridge and a groove are provided to permit a relative movement in the axial direction between said outer case and said inner case.

4. An electric sharpener in claim 2, wherein the end face of said inner case facing said sharpener section is provided with a protruded member and a motor output shaft runs through said protruded member and the outer circumferent surface can slide against an opening in a partition wall between said sharpener section and said inner case.

5. An electric sharpener in claim 4, wherein a means is provided between said protruded member and said sharpener section for dispersing over said inner case a pushing force applied to said sharpener section in the axial direction.

6. An electric sharpener in claim (5), wherein said pushing force dispersion means consists of a retaining ring and a washer, both of which are run through by said motor output shaft, and application of a pushing force to said sharpener section in the axial direction will cause said retaining ring and said washer to push the end face of said protruded member.

7. An electric sharpener in claim (1), wherein said battery consists of one or more nickel-cadmium cells.

* * * * *